United States Patent [19]

Höfle et al.

[11] 4,067,307

[45] Jan. 10, 1978

[54] FREE-JET-NOZZLE

[75] Inventors: Hubert Höfle, Eriskirch; Erwin Flesch, Uhldingen, both of Germany

[73] Assignee: Motoren- und Turbinen Union Friedrichshafen GmbH, Germany

[21] Appl. No.: 499,929

[22] Filed: Aug. 23, 1974

[30] Foreign Application Priority Data

Aug. 30, 1973 Germany ..... 2343655

[51] Int. Cl.[2] ..... F01P 1/04; A62C 31/02

[52] U.S. Cl. ..... 123/41.35; 123/41.36; 239/498; 239/600; 230/601

[58] Field of Search ..... 123/41.34, 41.35, 41.36, 123/41.42; 239/590, 590.5, 601, 596, 597, 600, 450, 460, 299, 498

[56] References Cited

U.S. PATENT DOCUMENTS

| | | | |
|---|---|---|---|
| 1,183,955 | 5/1916 | Cochran | 239/596 |
| 1,744,250 | 1/1930 | Trechsel | 123/41.35 |
| 2,569,103 | 9/1951 | Huber | 123/41.36 |
| 2,583,726 | 1/1952 | Chalom | 239/601 |
| 3,070,079 | 12/1962 | Seifert | 123/41.36 |
| 3,096,023 | 7/1963 | Thomas | 239/600 |
| 3,221,718 | 12/1965 | Isley | 123/41.35 |
| 3,275,248 | 9/1966 | O'Brien | 239/498 |
| 3,297,256 | 1/1967 | Hickerson | 239/597 |
| 3,313,490 | 4/1967 | Loveland | 239/600 |
| 3,314,612 | 4/1967 | Anthes | 239/601 |
| 3,561,536 | 6/1968 | Henshaw | 239/590 |

*Primary Examiner*—Charles J. Myhre
*Assistant Examiner*—Daniel J. O'Connor
*Attorney, Agent, or Firm*—Craig & Antonelli

[57] ABSTRACT

A free-jet-nozzle, particularly for the piston cooling system in reciprocating piston internal combustion engines, which is intended to forcibly bring about a vortex-free flow in the cooling medium flowing through the nozzle; the flow channel for the cooling medium is provided at least over a part of its length with radially inwardly extending, axially parallel ribs which leave open in the center of the flow channel a free cylindrical passage.

30 Claims, 3 Drawing Figures

FREE-JET-NOZZLE

The present invention relates to a free-jet-nozzle, especially for the piston cooling systems in reciprocating piston internal combustion engines, to forcibly bring about a vortex-free or eddy-free flow in the cooling medium flowing through the nozzle.

With the supply of the cooling medium, especially of oil, to the cooling space in the piston through a free-jet-nozzle secured at the cylinder crankcase, attention must be paid to the fact that an oil jet that is as focused or as closed as possible is produced by the free-jet nozzle, which reaches the intake opening at the piston as a closed jet in order that a sufficient rate of flow of cooling oil in the piston is achieved also in the upper dead-center position of the piston.

It is known to arrange in the nozzle a guide element constructed as a cross in order to achieve a bundled or focused oil jet. Even though a useful rate of oil flow in the piston is achieved thereby also in the upper dead-center position of the piston, the passing ability for dirt particles of the feed bore in the nozzle is so considerably restricted by the cross-shaped surfaces of the guide member which are disposed transversely in the oil stream that with a corresponding yield or accumulation of dirt, it may easily lead to a total clogging of the nozzle.

Accordingly, it is the object of the present invention to provide a free-jet nozzle for the piston cooling system, by means of which an optimum jet-focusing can be achieved without a clogging tendency endangering the operation.

The underlying problems are solved according to the present invention in that the flow channel for the cooling medium in the free-jet nozzle includes at least over a part of its length, radially inwardly extending, axially parallel ribs, which leave open in the center of the flow channel a free cylindrical passage.

One advantageous embodiment of the present invention consists in that a tubularly shaped insert is arranged in the flow channel for the cooling medium, which carries at its inner circumference the ribs.

The clogging danger of the free-jet-nozzle is additionally reduced according to the present invention in that the flow channel for the cooling medium or the tubularly shaped insert includes an inlet funnel and the ribs are bevelled off on the inlet side. As a result thereof, any dirt particles which are possibly carried along by the cooling medium, cannot deposit themselves but are torn along by the cooling medium stream.

According to the present invention, the height of the ribs is so dimensioned that the free cylindrical passage formed by the ribs is no smaller than the discharge bore of the free-jet-nozzle. A good jet-focusing with a minimal cross-sectional constriction in the flow channel results therefrom.

The advantages achieved with the present invention reside especially in that by the elimination of the clogging danger, the operational safety of the piston cooling system with the use of a free-jet-nozzle is increased, and in that the optimum jet-focusing in conjunction with the increase of the free passage produces an increased rate of flow of the cooling medium which considerably improves the efficiency of the piston cooling system.

These and other objects, features and advantages of the present invention will become more apparent from the following description, when taken in connection with the accompanying drawing which shows, for purposes of illustration only, one embodiment in accordance with the present invention, and wherein.

Figure 1:
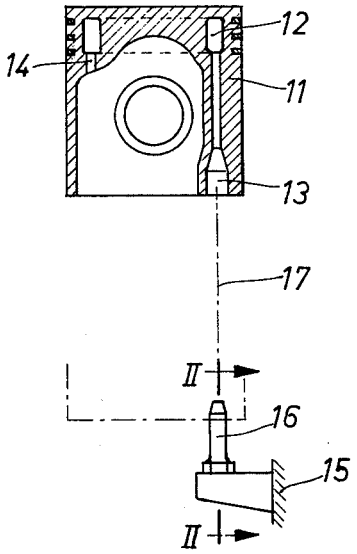
FIG. 1 is a schematic view of the arrangement of a free-jet-nozzle in the cylinder crankcase according to the present invention together with the associated piston in the upper dead-center position.

Referring now to the drawing wherein like reference numerals are used throughout the various views to designate like parts, FIG. 1 illustrates an oil-cooled piston 11 of a reciprocating piston internal combustion engine (not shown) in the upper dead-center position. The cooling oil is supplied as a free jet 17 to the cooling space 12 within the piston 11 by a nozzle 16 secured at the cylinder crankcase 15 by way of the intake opening 13 provided in the piston and again leaves the piston 11 by way of the discharge opening 14.

Figure 2:
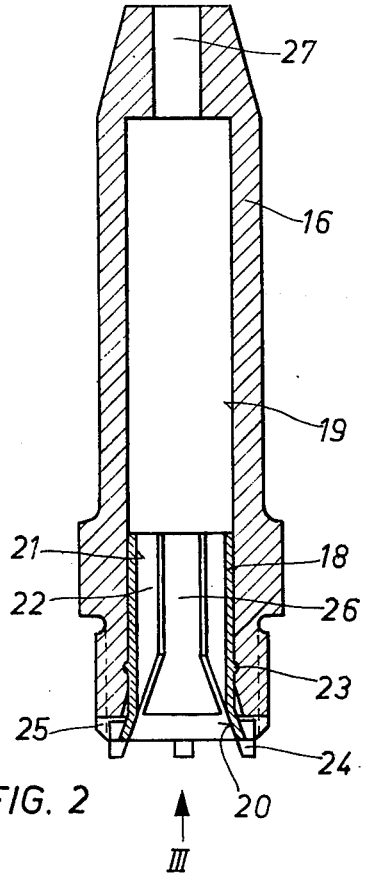
FIG. 2 is a cross-sectional view, on an enlarged scale, through a free-jet-nozzle with an insert in accordance with the present invention, taken along line II'II in FIG. 1.
Figure 3:
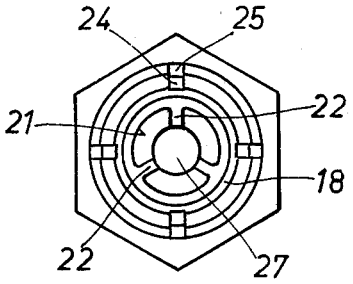
FIG. 3 is an end elevational view of the insert taken in the direction of arrow III in FIG. 2.

In order to assure a high rate of flow of cooling oil also in the upper dead-center position of the piston 11, a good focusing of the free oil-jet 17 is required. This is achieved in that the flow channel 19 (FIG. 2) for the cooling oil is provided over a part of its length with radially inwardly extending, axially parallel ribs 22. An eddy-free or vortex-free flow is thereby enforced in the cooling oil flowing through the free-jet-nozzle 16, which enters the nozzle 16 strongly turbulent or vortexing as a result of the unavoidable numerous deflections in the feed line. By reason of the fact that the ribs 22 leave open a free cylindrical passage 26 in the center of the flow channel 19, the free-jet-nozzle 16 can practically no longer clog up.

In the illustrated embodiment, a tubularly shaped insert 18 is arranged in the flow channel 19 for the cooling oil, which carries at its inner circumference 21 the ribs 22.

The clogging danger of the free-jet-nozzle 16 is still further reduced in that the tubularly shaped insert 18 includes an inlet funnel 20 and the ribs 22 are bevelled off at the inlet side. Any dirt particles which possibly might be taken along by the cooling oil can no longer deposit themselves quite as easily as a result thereof and are torn along by the cooling oil stream.

The rib height is so dimensioned that the free cylindrical passage 26 formed by the ribs 22 is not smaller than the discharge bore 27 of the free-jet-nozzle 16. A good jet-focusing with a lesser throttling effect of the insert 18 on the cooling oil stream results therefrom than with the prior art constructions whereby an increase in the rate of flow of the cooling oil in the piston 11 was achieved.

The fastening of the insert 18 in the axial direction takes place by means of several knubs or barbs 23 distributed over the circumference which coincide with a corresponding circumferential groove of the flow channel 19. A fastening of the insert 18 secure against rotation is achieved by four radially outwardly projecting lugs 24 at the inlet funnel 20, which engage into corresponding grooves 25 provided in the nozzle body.

The application of the described free-jet-nozzle is not limited to the piston cooling system but may be applied in all cases where a good jet focusing and slight clogging tendency is important, for example, in the fluid technology generally speaking in the oil lubrication of roller bearings and similar applications.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A free-jet-nozzle intended to bring about a substantially vortex-free flow of cooling medium flowing through the nozzle characterized in that the nozzle is provided with a flow channel means for the cooling medium which includes at least over a portion of its length, radially inwardly extending rib means, said rib means leaving open in the center of the channel means a free passage, said rib means including a plurality of elongated spaced rib members extending in the axial direction of the nozzle, said flow channel means being constructed to provide a focused discharge jet of the cooling medium.

2. A free-jet-nozzle according to claim 1, characterized in that said passage is substantially cylindrical.

3. A free-jet-nozzle according to claim 2, characterized in that the rib means are axially parallel.

4. A free-jet nozzle according to claim 3, characterized in that the nozzle forms part of a piston cooling system for a reciprocating piston internal combustion engine.

5. A free-jet-nozzle according to claim 3, characterized in that a tubularly shaped insert means is arranged in the flow channel means which carries at its inner circumference the rib means.

6. A free-jet-nozzle according to claim 5, characterized in that an inlet funnel means is provided on the inlet side of the nozzle.

7. A free-jet-nozzle according to claim 6, characterized in that the flow channel means forms the inlet funnel means.

8. A free-jet-nozzle according to claim 6, characterized in that the insert means forms the inlet funnel means.

9. A free-jet-nozzle according to claim 6, characterized in that the rib means are bevelled off on the inlet side.

10. A free-jet-nozzle according to claim 9, characterized in that the height of the rib means is so dimensioned that the free passage formed by the rib means is no smaller than the discharge bore of the free-jet-nozzle.

11. A free-jet-nozzle according to claim 10, characterized in that the nozzle forms part of a piston cooling system for a reciprocating piston internal combustion engine.

12. A free-jet-nozzle according to claim 1, characterized in that a tubularly shaped insert means is arranged in the flow channel means which carries at its inner circumference the rib means.

13. A free-jet-nozzle according to claim 1, characterized in that an inlet funnel means is provided on the inlet side of the nozzle.

14. A free-jet-nozzle according to claim 13, characterized in that the flow channel means forms the inlet funnel means.

15. A free-jet-nozzle according to claim 13, characterized in that the insert means forms the inlet funnel means.

16. A free-jet-nozzle according to claim 13, characterized in that the rib means are bevelled off on the inlet side.

17. A free-jet-nozzle according to claim 1, characterized in that the height of the rib means is so dimensioned that the free passage formed by the rib means is no smaller than the discharge bore of the free-jet-nozzle.

18. A free-jet-nozzle according to claim 1, characterized in that the rib means are bevelled off on the inlet side.

19. A free-jet-nozzle according to claim 18, characterized in that lugs integral with the rib means are provided which engage in corresponding apertures provided in the nozzle to prevent a rotation of the rib means.

20. A free-jet-nozzle according to claim 1, characterized by means for holding the rib means fast in the axial direction.

21. A free-jet-nozzle according to claim 20, characterized by further means for holding the rib means fast in the direction of rotation.

22. A free-jet-nozzle according to claim 1, wherein said rib means are configured and arranged for aiding in focusing the free-jet flow of cooling medium exiting from said flow channel means.

23. A free-jet-nozzle according to claim 22, characterized in that the rib means are axially parallel.

24. A free-jet-nozzle according to claim 22, characterized in that an inlet funnel means is provided on the inlet side of the nozzle.

25. A free-jet-nozzle according to claim 22, characterized in that the height of the rib means is so dimensioned that the free passage formed by the rib means is no smaller than the discharge bore of the free-jet-nozzle.

26. A free-jet-nozzle according to claim 22, characterized in that the rib means are bevelled off on the inlet side to form inlet funnel means of decreasing dimension in the direction of flow.

27. A free-jet-nozzle according to claim 22, wherein said rib means extend radially inwardly from the inner circumference of the flow channel means.

28. A free-jet-nozzle according to claim 1, characterized in that lugs integral with the rib means are provided which engage in corresponding apertures provided in the nozzle to prevent a rotation of the rib means.

29. A free-jet-nozzle according to claim 22, characterized in that lugs integral with the rib means are provided which engage in corresponding apertures provided in the nozzle to prevent a rotation of the rib means.

30. A free-jet-nozzle according to claim 1, characterized in that the spaced rib members extend radially inwardly from the inner circumference of the flow channel means, the extent of the rib members in the axial direction being greater than the extent in the radial direction.

* * * * *